US007954286B2

(12) United States Patent
Khan et al.

(10) Patent No.: US 7,954,286 B2
(45) Date of Patent: Jun. 7, 2011

(54) HEAT WELDABLE PIPE CURB ACCESSORY

(75) Inventors: Amir Khan, Wayne, NJ (US); Edward Nebesnak, Mine Hill, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 432 days.

(21) Appl. No.: 11/442,411

(22) Filed: May 26, 2006

(65) Prior Publication Data

US 2007/0272341 A1 Nov. 29, 2007

(51) Int. Cl.
*E04D 13/14* (2006.01)

(52) U.S. Cl. ..... 52/219; 52/58; 52/60; 52/584.1; 52/588.1; 52/741.4; 249/6; 249/8; 249/208; 285/42; 285/43; 285/44; 285/65; 285/419; 156/71; 156/91

(58) Field of Classification Search ..... 249/2, 6, 249/8, 208; 52/58, 60, 219, 584.1, 588.1, 52/741.4, 742.13; 156/71, 304.1, 304.6, 156/91, 94; 285/42, 43, 44, 65, 419
See application file for complete search history.

(56) References Cited

U.S. PATENT DOCUMENTS

| | | | | | |
|---|---|---|---|---|---|
| 1,494,234 | A * | 5/1924 | Gossett | 285/42 |
| 1,905,856 | A * | 4/1933 | Haase et al. | 52/100 |
| 3,247,632 | A * | 4/1966 | Bloxsom | 52/200 |
| 3,708,185 | A * | 1/1973 | Bilicki et al. | 285/42 |
| 3,838,544 | A * | 10/1974 | Hindall | 52/60 |
| 4,635,409 | A * | 1/1987 | Vandemore | 52/60 |
| 4,730,421 | A * | 3/1988 | Leeland | 52/58 |
| 4,738,057 | A * | 4/1988 | Logan | 52/2.17 |
| 4,774,795 | A * | 10/1988 | Braun | 52/396.07 |
| 4,928,443 | A * | 5/1990 | Goodman et al. | 52/58 |
| 4,934,093 | A * | 6/1990 | Yanna | 47/33 |
| 4,937,991 | A * | 7/1990 | Orth | 52/199 |
| 5,309,579 | A * | 5/1994 | Nelson | 4/252.1 |
| 5,493,827 | A | 2/1996 | Georgeau et al. | |
| 5,746,031 | A * | 5/1998 | Burns | 52/170 |
| 5,768,838 | A | 6/1998 | Georgeau | |
| 5,946,863 | A * | 9/1999 | Bullard | 52/58 |
| 5,970,667 | A * | 10/1999 | Thaler | 52/219 |
| 6,021,620 | A * | 2/2000 | Vermilion et al. | 52/741.4 |
| 6,601,351 | B1 * | 8/2003 | Zerfoss | 52/198 |
| 6,623,578 | B2 * | 9/2003 | Wasitis et al. | 156/71 |
| 7,386,958 | B2 * | 6/2008 | Quarles | 52/198 |
| 2005/0172569 | A1 * | 8/2005 | Jutras | 52/219 |
| 2007/0094984 | A1 * | 5/2007 | McClure | 52/580 |

* cited by examiner

*Primary Examiner* — Joseph S Del Sole
*Assistant Examiner* — Seyed Masoud Malekzadeh
(74) *Attorney, Agent, or Firm* — William J. Davis; Sills Cummins & Gross P.C.

(57) ABSTRACT

A target piece for sealing mechanical penetrations in single ply roofing membranes is provided. The target piece comprises a left piece and a right piece, or a single unified piece. The left piece can be applied on one side of the one or more mechanical penetrations, and the right piece can be applied on an opposite side of the one or more mechanical penetrations. Alternatively, the unified piece can be applied on the one or more mechanical penetrations. Left and right curb elements are attached to a top of the left piece and right piece, respectively. Faces of the left and right pieces are sealed to each other and faces of the left and right curb elements are sealed to each other using an adhesive/heat seal, thus forming a pocket around the mechanical penetrations, and then sealant is poured into the pocket to seal the mechanical penetrations. Extensions are provided on ends of either the right or left pieces of the target piece to provide extra insurance against water leakage.

7 Claims, 3 Drawing Sheets

HEAT WELDABLE PIPE CURB ACCESSORY

BACKGROUND OF THE INVENTION

1. Field of the Invention

The present invention relates generally to sealing of mechanical penetrations in a roofing membrane, and more specifically, to a pipe curb accessory for single ply roofing membranes covering a roof deck.

2. Prior Art

A roofing system generally includes a roof deck which is considered the structural supporting surface of a building extending between the surrounding exterior walls of the building. The roof deck may be constructed from plywood, metal decking or concrete or any other suitable material. Depending upon the construction, the roof deck may extend over the surrounding exterior walls or the roof deck may stop short of the exterior walls thereby forming a parapet wall, i.e., a low retaining wall at the edge of the roof deck. If desired, the roofing system may also include an insulation barrier formed from polyisocyanarate or any other suitable material applied over the roof deck.

To make the roof deck and building weather resistant a single-ply membrane roof is installed over the roof deck. The single-ply membrane roof refers to a water impermeable single sheet of polymeric material such as ethylene propylene diene rubber (EPDM) having a preapplied hot melt adhesive, chlorinated polyethylene, polyvinyl chloride, or chlorosulfanated polyethylene. The membrane roof has heretofore been installed on the roof deck using a variety of different methods.

In a typical low slope, single-ply membrane roof, provision must be made for sealing penetrations of the roof by vent pipes, support straps, conduits, guy anchors and similar elements. Generally, a pitch pocket or pan (a flanged, open bottomed enclosure made of sheet metal or other material, placed around a penetration through the roof, filled with grout and bituminous or polymeric sealants to seal the area around the penetration), which surrounds the penetrating element is used. A sealant is poured into the pan around the penetrating element. Various types of pitch pockets or pans have been proposed. Examples may be found in U.S. Pat. No. 3,838,544 entitled Adjustable Pitch Pocket Structure, which issued on Oct. 1, 1974, to Hindall; U.S. Pat. No. 4,928,443 entitled Pourable Sealer Pocket, which issued on May 29, 1990, to Goodman et al.; U.S. Pat. No. 4,934,117 entitled Pitch Pocket and Method of Forming Same, which issued on Jun. 19, 1990, to Barksdale; U.S. Pat. No. 4,937,991 entitled Flashing Unit for Sealing Roof Penetrations, which issued on Jul. 3, 1990, to Orth; U.S. Pat. No. 5,493,827 entitled Pitch Pocket, which issued on Feb. 27, 1996, to Georgeau et al; and U.S. Pat. No. 5,768,838 entitled Polyurethane Pitch Pocket, which issued on Jun. 23, 1998 to Georgeau et al.

In one approach, a prefabricated angle iron flange, at least two inches deep, is fabricated away from the job site. The flange is bonded to the roofing membrane with a solvent-based contact cement, thus forming a metal dam around the roof penetration. Sheet rubber flashing is applied to the outer surfaces of the flange with contact cement to prevent rusting and corrosion. The perimeter of the applied rubber flashing is then sealed with a bead of solvent-based rubber caulking to keep it from being underridden by water. A two-part urethane rubber pourable sealant is mixed and poured into the cavity until it is level with the top of the metal flange. The liquid rubber cures to form a solid rubber seal around the roof penetration.

However, the rubber seal over time often was penetrated by water because it was not properly applied or because over time the seal gave way. Further, the installation of available pitch pans is time consuming, complicated and expensive. The process generally takes about forty five minutes per unit and is labor intensive. The complexity of the procedure under field conditions has caused errors in workmanship and improper installations, leading to failure of the seal formed by the pitch pan. Because of the time and expense associated with traditional pitch pans, many contractors have compensated by filling the pan cavity with sand, mortar or urethane foam and covering the top surface with caulk to give the appearance of a solid rubber seal. These practices have lead to frequent leaks and failures that make traditional pitch pans unreliable.

Therefore, a need exists for a leak proof system for single ply roofing membranes which simplifies field application, which reduces the cost of materials and which provides for a more reliable waterproof seal between a roof membrane and penetration therein.

SUMMARY OF THE INVENTION

One object of the present invention is to provide a heat weldable pipe curb for single ply roofing applications. One embodiment of the invention uses a target piece that is flashed around the polymeric penetration, where the target piece has an extension that allows for a heat sealable water tight overlap for extra insurance. Either one-part or two-part pourable sealants can be poured directly into the curb. Yet other objects of the present invention are to provide a water proof mechanical penetration in thermoplastic roofing membranes that is faster to install, where a minimum amount of substrates are adhered, where no extra primers are required, which is easier to handle, and eliminates the need for call backs.

Accordingly, a target piece for sealing one or more mechanical penetrations is provided, the target piece comprising a left piece applied on one side of the one or more mechanical penetrations, and a right piece applied on an opposite side of the one or more mechanical penetrations, wherein left and right curb elements are attached to a top of the left piece and right piece, respectively. The left piece can comprise a left inner piece and a left outer piece, and the right piece can comprise a right inner piece and a right outer piece.

The target piece for sealing one or more mechanical penetrations further comprises extensions on ends of the right piece that overlap on the top of the ends of the left piece to provide extra insurance against water leakage. The left piece and right piece can be semi-circular.

The left and right curb elements can be attached to a top of the left piece and right piece with an adhesive/heat seal. The adhesive/heat seal is selected from the group consisting of a butyl compound or other waterproofing compound such as single component PVAc (polyvinyl acetate) water-resistant adhesive, water-resistant polyvinyl acetate adhesive, EVA (ethylene vinyl acetate)-hot melt adhesives, pressure sensitive hot melt adhesive atactic polypropylene (APP) base pressure sensitive tapes, polyurethane adhesives, thermoplastic adhesive film based with co-polyamides, thermoplastic adhesive film based with mixed polyolefin and co-polyamide, animal base adhesive, asphaltic base adhesive styrol or verstat acrylate types, neoprene rubber and cementitious base adhesive.

The t left piece and right piece can be attached on opposite ends to each other by use of an adhesive/heat seal, forming a pocket around the one or more mechanical penetrations. The left piece and right piece can also be a single unified piece.

Further, a method of sealing one or more mechanical penetrations is provided, the method comprising attaching a left side of a curb element to a left piece of a target piece, attaching a right side of a curb element to a right piece of a target piece, attaching the left piece and left curb element on one side of the one or more mechanical penetrations, and attaching the right piece and right curb element on an opposite side of the one or more mechanical penetrations.

The method of sealing one or more mechanical penetrations further comprises sealing faces of the left target piece on its outer ends to faces of the right target piece on its outer ends using a heat seal. The method of sealing one or more mechanical penetrations further comprises sealing faces of the left curb element on its outer ends to faces of the right curb element on its outer ends using an adhesive/heat seal, thus forming a pocket around the one or more mechanical penetrations.

The method of sealing one or more mechanical penetrations further comprises pouring sealant in the pocket to seal the one or more mechanical penetrations. The method of sealing one or more mechanical penetrations further comprises attaching extensions on the ends of the left piece over a top of the ends of the right piece to provide extra insurance against water leakage.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of roofing structures, it has been found particularly useful in the environment of water sealing mechanical penetrations in thermoplastic roofing membranes. Therefore, without limiting the applicability of the invention to the above, the invention will be described in such environment.

Figure 1:
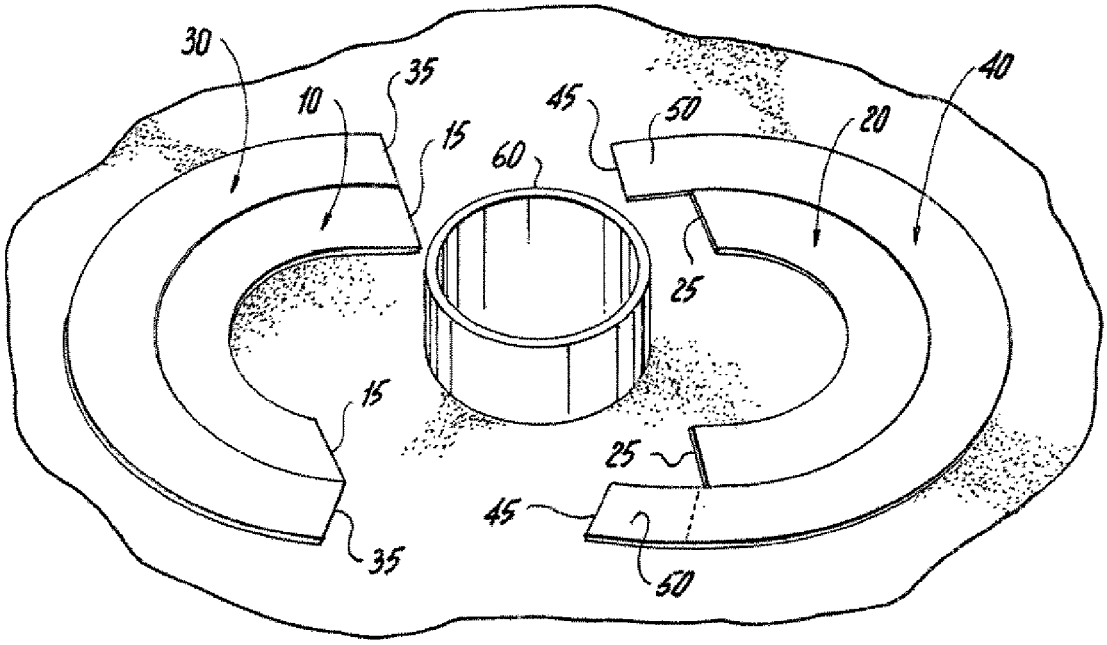
FIG. 1 illustrates a perspective view of a target piece around a mechanical penetration in accordance with the principles of the present invention.

With reference now to the drawings, the heat weldable pipe curb accessory of the present invention will be described. FIG. 1 illustrates an embodiment of the present invention, a target piece having four semi-circular components. Specifically, the target piece comprises left inner piece 10, right inner piece 20, left outer piece 30 and right outer piece 40. The left inner piece 10 and left outer piece 30 can be one left piece attached or separate, as can the right inner piece 20 and right outer piece 40. These pieces are comprised of a thermoplastic membrane. Left and right inner pieces 10, 20 define opposed, angled joint faces 15, 25, respectively. Faces 15, 25 are formed on a diagonal or are angled with respect to the centerline of each piece. Similarly, left and right outer pieces 30, 40 define opposed, angled joint faces 35, 45, respectively. Faces 35, 45 are formed on a diagonal or are angled with respect to the centerline of each piece.

Further, right outer piece 40 has flaps 50 that extend past the faces 45. Left inner piece 10 and right inner piece 20 form a full circle when the faces 15, 25 are in a butting relationship, as do left outer piece 30 and right outer piece 40. The flaps 50 of right outer piece 40 lie over left outer piece 30, which will be described below in detail. The target piece is formed around mechanical penetration 60, which represents a penetration in a single ply roofing membrane for purposes of the figure.

Figure 2:
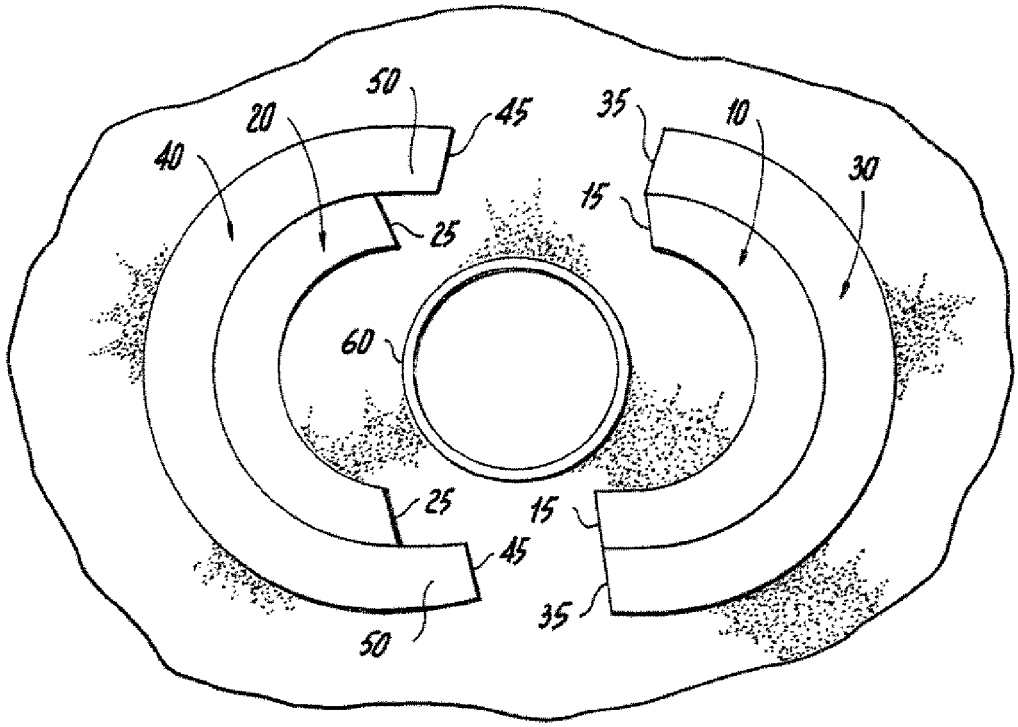
FIG. 2 illustrates a perspective view of the target piece and curb elements around a mechanical penetration in accordance with the principles of the present invention.

As shown in FIG. 2, a polymeric curb is usually formed of two semi-circular curb elements, a left curb element 70 and a right curb element 80. Curb elements 70, 80 define opposed, angled joint faces 75, 85. Faces 75, 85 are formed on a diagonal or are angled with respect to the centerline of each element. The curb elements 70, 80 are substantially mirror elements of each other. When positioned together with joint faces 75, 85 in a butting relationship, as will be described below, the elements essentially form a circular curb. The elements can be formed of a thermoplastic or thermoset based material.

As seen in FIG. 2, the pieces 10, 20, 30 and 40 of the target piece are brought around a mechanical penetration 60. Of course it will be understood that more than one mechanical penetration can be sealed using the present invention and one penetration 60 is shown only for purposes of the figure. It can be appreciated that the flaps 50 are interchangeable between the outer pieces, and the flaps 50 shown on right outer piece 40 in FIG. 1 can also be on left outer piece 30 as shown in FIG. 2.

Figure 3:
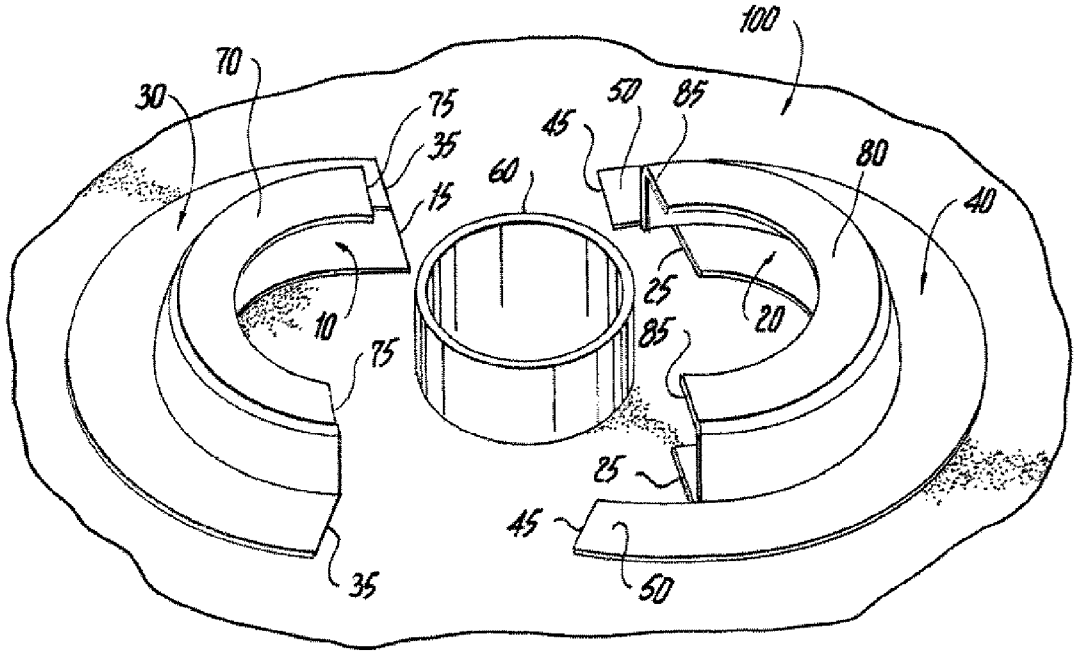
FIG. 3 illustrates the application of the curb elements to the target piece in accordance with the principles of the present invention.

In FIG. 3, the left curb element 70 is placed on top of left inner piece 10, and the right curb element is placed on top of right inner piece 20. The curb elements 70, 80 are sealed to the inner pieces 10, 20, respectively, by means of an adhesive or heat seal. The adhesive or heat seal is applied to an undersurface of each curb element 70, 80. The adhesive or heat seal secures the left and right curb elements 70, 80 to the left and right inner pieces 10, 20, respectively. The adhesive can be a butyl compound or other waterproofing compound such as single component PVAc (polyvinyl acetate) water-resistant adhesive, water-resistant polyvinyl acetate adhesive, EVA (ethylene vinyl acetate)-hot melt adhesives, pressure sensitive hot melt adhesive atactic polypropylene (APP) base pressure sensitive tapes, polyurethane adhesives, thermoplastic adhesive film based with co-polyamides, thermoplastic adhesive film based with mixed polyolefin and co-polyamide, animal base adhesive, asphaltic base adhesive styrol or verstat acrylate types, neoprene rubber and cementitious base adhesive.

Figure 4:
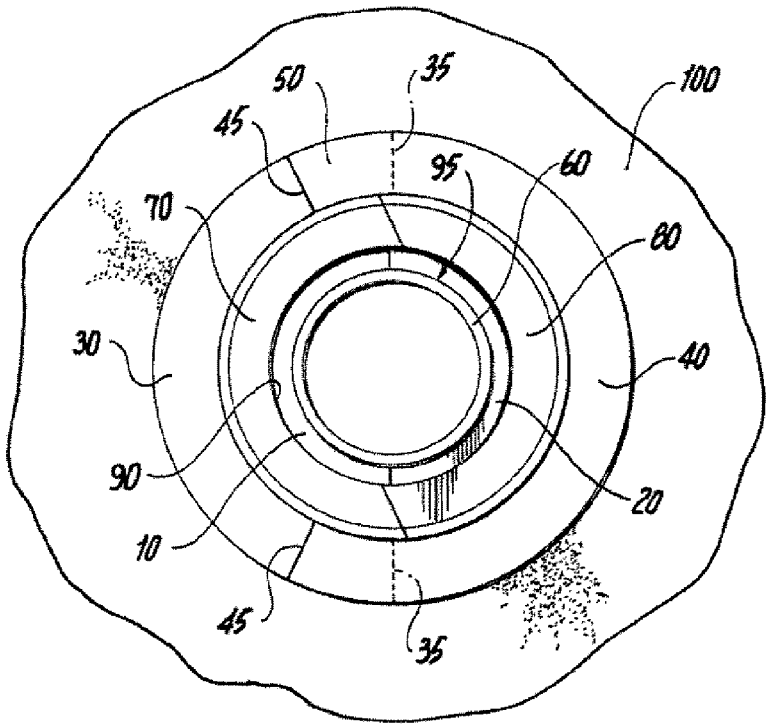
FIG. 4 illustrates the application of the target piece to a roof deck in accordance with the principles of the present invention.

After, as shown in FIG. 4, the left and right inner pieces 10, 20 are formed around the mechanical penetration 60 and the underside of the left and right inner pieces are sealed to the roof deck 100 in which the penetration 60 lies by use of an adhesive. Faces 15, 25, as shown in FIG. 2, are brought together in a butting relationship and sealed by use of an adhesive on the faces. The underside of the left and right outer pieces 30, 40 are also sealed to the roof deck 100 by use of an adhesive, and the faces 35, 45, as shown in FIG. 2, are brought together in a butting relationship and sealed by use of an adhesive on the faces. As shown in FIG. 3, flaps 50 of left outer piece 30 overlap right outer piece 40, as will be described in detail below.

Simultaneously, curb elements 70, 80 are brought together so that faces 75, 85, as shown in FIG. 4, attach to each other in a butting relationship, and are sealed. In the preferred form, the curb elements 70, 80 are joined by an adhesive or heat seal which is applied to the joint faces 75, 85. Preferably, butyl/urethane calk is used as the adhesive.

As shown in FIG. 4, curb elements 70, 80 each include an inner peripheral surface 90. When the curb elements 70, 80 are joined together and positioned on the left and right inner pieces 10, 20, which are positioned on a roof deck 100, the curb (comprised of left and right curb elements 70, 80), together with left and right inner pieces 10, 20 define a pocket 95 which receives a sealant. The pourable sealant can be either a one-part or two-part sealant and poured directly into the pocket 95.

The curb is formed with the two components 70, 80 to simplify installation. The two halves may readily be placed around a roof penetration 60 with left and right inner pieces 10, 20. The ring shape of the preferred curb reduces the quantity of sealant necessary to fill pocket 90 than would be required if the curb had a rectangular configuration.

Figure 5:
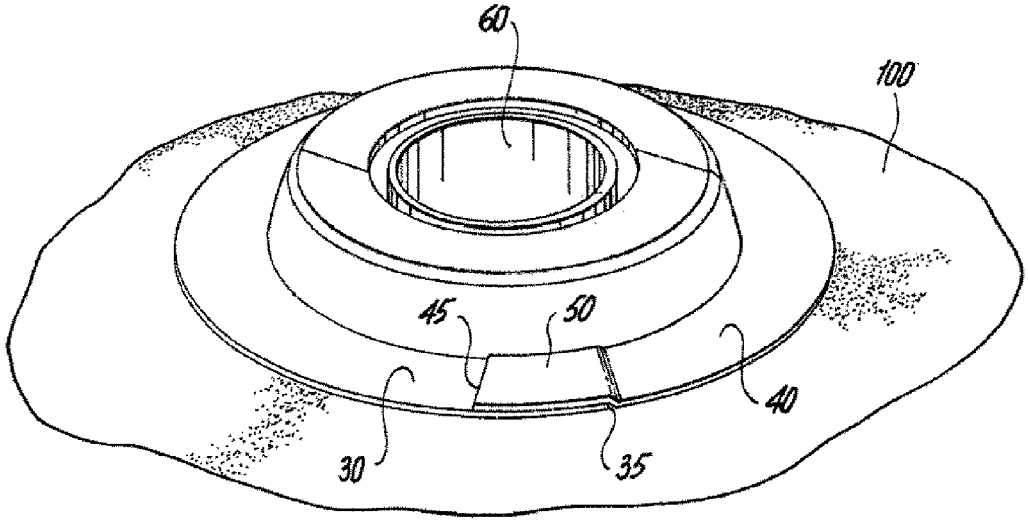
FIG. 5 illustrates the application of an extension of the target piece in accordance with the principles of the present invention.
Figure 6:
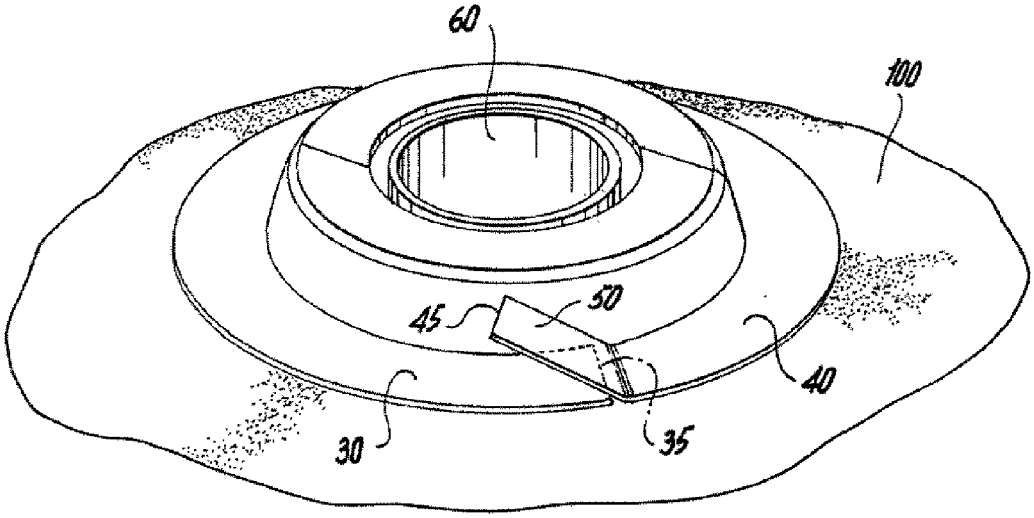
FIG. 6 further illustrates the application of the extension of the target piece in accordance with the principles of the present invention.

Further, the flap 50 or extension of an outer piece is further shown in detail in FIG. 5. Here, once the faces 35, 45 of outer pieces 30, 40 are joined and sealed by an adhesive/heat seal, the flap 50 of right outer piece 40 is laid on top of left outer piece 30. The flap 50 or extension provides for a heat sealable water tight overlap for extra insurance against leakage. The flap 50 is sealed to the top of the outer piece 30 by a heat seal. FIG. 6 shows specifically the flap 50, and how it is raised above the left outer piece 30 and then laid on top of it, providing extra assurance that no water will leak through the penetration 60 after heat sealing.

The curb elements 70 and 80 are preformed or cast from a lightweight thermoset or thermoplastic composition. The composition of the curb elements provides mechanical protection for the contained sealant. The curb elements are impervious to corrosion, ultraviolet light and the rigors of roof-top environments. The configuration of the curb elements, including the curved outer surfaces, along with the target piece comprised of the inner and outer pieces, allows the target piece and curb elements to shed water and keep ice away from the mechanical penetration 60.

When filled with sealant, the target piece and curb elements raise the point of entry of the roof penetration the same height above the roofline and away from standing water.

The present invention provides several advantages that solve the problems with prior art methods. It provides a target piece that aids the curb elements in preventing water from penetrating through the roof due to mechanical penetrations. This piece aids the curb elements in preventing leakage into the mechanical penetration of the roof, and helps the curb elements in the formation of a pocket where the sealant is formed. It is also quick to install and easy in handling.

The above description of the present invention is only the preferred embodiment of the invention. Embodiments may include any currently or hereafter-known versions of the elements described herein. Different adhesives may be used on the faces of the inner and outer pieces and curb elements, and for attaching the curb elements to the target piece. Various sealants can also be used for sealing the mechanical penetration(s). Different materials may be used to form the curb elements or the target piece. The target piece does not have to be four different pieces, and can easily be comprised of a left piece and a right piece (left inner piece and left outer piece would together comprise one left piece, and the right inner piece and right outer piece would together comprise one right piece). Also, the target piece can be formed around several mechanical penetrations and is not limited to surrounding one mechanical penetration. Various sizes of the target piece can be made that accommodate various sizes and numbers of mechanical penetrations. The target piece is not limited to a circular shape, and can comprise a rectangular, square, spherical, or any other geographical shape that surrounds the mechanical penetration(s).

Further, the left piece (comprising left inner piece and left outer piece) and right piece (comprising right inner piece and right outer piece) can be one single unified piece. Accordingly, the curb elements can be placed directly on the unified piece, which is then placed around the mechanical penetration. Alternatively, the unified piece can first be placed directly around the mechanical penetration, and then the curb elements can be applied to the unified piece. Therefore, the left and right piece as described above do not have to be two separate piece, and can refer to a left and right side of a single unified piece.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A target piece for sealing one or more mechanical penetrations, the target piece comprising:

a substantially flat left piece applied on an opposite side of the one or more mechanical penetrations; and a substantially flat right piece applied on an opposite side of the one or more mechanical penetrations;

wherein left and right curb elements are attached to a top of the left piece and right piece, respectively; each of the left and right curb elements comprising: (a) a substantially curved side surface that is attached to the top of the left or right piece respectively, and (b) a substantially flat top surface that is substantially parallel to the plane on which the target piece is disposed; the side surface and the top surface being angled relative to each other; the left and right curb elements joined together to define a pocket underneath the joined curb elements; and extensions on ends of the right piece that overlap on the top of the ends of the left piece, wherein the extensions on ends of right piece are sealed to the top of the ends of the left piece with an adhesive.

2. The target piece for sealing one or more mechanical penetrations of claim 1, wherein the left piece comprises a left inner piece and a left outer piece, and the right piece comprises a right inner piece and a right outer piece.

3. The target piece for sealing one or more mechanical penetrations of claim 1, wherein the left piece and right piece are semi-circular.

4. The target piece for sealing one or more mechanical penetrations of claim 1, wherein the left and right curb elements are attached to a top of the left piece and right piece respectively with an adhesive/heat seal.

5. The target piece for sealing one or more mechanical penetrations of claim 4, wherein the adhesive/heat seal is selected from the group consisting of a butyl compound, single component PVAc (polyvinyl acetate) water-resistant adhesive, water-resistant polyvinyl acetate adhesive, EVA (ethylene vinyl acetate)-hot melt adhesives, pressure sensitive hot melt adhesive atactic polypropylene (APP) base pressure sensitive tapes, polyurethane adhesives, thermoplastic adhesive film based with co-polyamides, thermoplastic adhesive film based with mixed polyolefin and co-polyamide, animal base adhesive, asphaltic base adhesive styrol or verstat acrylate types, neoprene rubber and cementitious base adhesive.

6. The target piece for sealing one or more mechanical penetrations of claim 1, wherein the left piece and right piece are attached on opposite ends to each other by use of an adhesive/heat seal, forming a pocket around the one or more mechanical penetrations.

7. The target piece for sealing one or more mechanical penetrations of claim 1, wherein the left piece and right piece are each a single unified piece.

* * * * *